US007645004B2

(12) United States Patent
An et al.

(10) Patent No.: US 7,645,004 B2
(45) Date of Patent: Jan. 12, 2010

(54) LIQUID DROPLET EJECTION DEVICE, LIQUID DROPLET EJECTION METHOD, MANUFACTURING METHOD OF ELECTRO-OPTICAL DEVICE, ELECTRO-OPTICAL DEVICE AND ELECTRONIC EQUIPMENT

(75) Inventors: Eishoku An, Shimo (JP); Yoshiaki Murayama, Shojiri (JP)

(73) Assignee: Seiko Epson Corporation (JP)

( * ) Notice: Subject to any disclaimer, the term of this patent is extended or adjusted under 35 U.S.C. 154(b) by 396 days.

(21) Appl. No.: 11/288,456

(22) Filed: Nov. 29, 2005

(65) Prior Publication Data

US 2006/0119629 A1 Jun. 8, 2006

(30) Foreign Application Priority Data

Dec. 8, 2004 (JP) ..... 2004-354995
Sep. 21, 2005 (JP) ..... 2005-273404

(51) Int. Cl.
*B41J 29/38* (2006.01)

(52) U.S. Cl. ..... 347/5

(58) Field of Classification Search ..... 347/20, 347/22, 29, 30, 33, 37, 39, 40, 104, 2, 5, 347/8, 9, 102, 215, 13; 310/12
See application file for complete search history.

(56) References Cited

U.S. PATENT DOCUMENTS 5,898,449 A * 4/1999 Narang et al. ..... 347/87
6,207,948 B1 * 3/2001 Yokoi et al. ..... 250/226
7,240,982 B2 * 7/2007 Sanpei et al. ..... 347/23
2002/0005870 A1 * 1/2002 Codos et al. ..... 347/9
2003/0142167 A1 * 7/2003 Nakamura et al. ..... 347/37
2003/0189604 A1 * 10/2003 Bae et al. ..... 347/2
2003/0222936 A1 * 12/2003 Kaneko ..... 347/19
2004/0150269 A1 * 8/2004 Maki et al. ..... 310/12

FOREIGN PATENT DOCUMENTS

| | | |
|---|---|---|
| JP | 56-5775 | 1/1981 |
| JP | 06-079956 | 3/1994 |
| JP | 09-101412 | 4/1997 |
| JP | 2000-111677 | 4/2000 |
| JP | 2004-90336 | 3/2004 |
| JP | 2005-224723 | 8/2005 |

* cited by examiner

*Primary Examiner*—Stephen D Meier
*Assistant Examiner*—Alexander C Witkowski
(74) *Attorney, Agent, or Firm*—Harness, Dickey & Pierce, P.L.C.

(57) ABSTRACT

A liquid droplet ejection device for ejecting a liquid from a nozzle of a head to a workpiece, the liquid droplet ejection device including: a table for loading the workpiece; a first shifting section capable of shifting the table in a first direction and in a second direction approximately intersecting the first direction at a right angle; a plurality of carriages having the head; and a second shifting section capable of positioning each of the carriages by mutually shifting each of the carriages along the second direction.

4 Claims, 13 Drawing Sheets

FINISH STATUS OF FIRST TIME DRAWING

FINISH STATUS OF SECOND TIME DRAWING

FINISH STATUS OF THIRD TIME DRAWING

FINISH STATUS OF FIRST TIME DRAWING

FINISH STATUS OF SECOND TIME DRAWING

FINISH STATUS OF THIRD TIME DRAWING

LIQUID DROPLET EJECTION DEVICE, LIQUID DROPLET EJECTION METHOD, MANUFACTURING METHOD OF ELECTRO-OPTICAL DEVICE, ELECTRO-OPTICAL DEVICE AND ELECTRONIC EQUIPMENT

CROSS REFERENCE TO RELATED APPLICATIONS

This application claims priority to Japanese Patent Application Nos. 2004-354995 filed Dec. 8, 2004 and 2005-273404 filed Sep. 21, 2005 which are hereby expressly incorporated by reference herein in their entirety.

BACKGROUND OF THE INVENTION

1. Technical Field

The invention relates to a liquid droplet ejection device which ejects a liquid from a nozzle of a head to a workpiece, a liquid droplet ejection method, a manufacturing method of an electro-optical device, an electro-optical device, and electronic equipment.

2. Related Art

A liquid droplet device may be used as a drawing system designed to eject a liquid droplet by an inkjet method to a workpiece. The drawing system may be used in manufacturing an electro-optical device such as a flat-panel display.

A liquid droplet ejection device ejecting a liquid by the inkjet method has a head for ejecting the liquid droplet. In view of this existing technology, there is proposed a device ejecting ink for a color filter to a glass substrate by using such head (first related art example).

JP-3159919 is an example of related art (p. 4 or p. 6, FIG. 1).

This type of liquid droplet ejection device has a carriage holding a head which is constructed such that the carriage shifts to a different area upon completion of drawing in an area where there is a glass substrate.

On the other hand, for example, work on manufacturing the flat-panel display with a larger screen is proceeding, and work on manufacturing a larger glass substrate used for such a flat-panel display is also proceeding. Consequently, in case of drawing over an entire surface of a large glass substrate by ejecting a liquid, a shifting distance of a carriage having a head becomes long, so that there is a problem of not being able to improve productivity of the workpiece through liquid ejection.

SUMMARY

An advantage of some aspects of the invention is to provide a liquid droplet ejection device which can eliminate the above-referenced problem and which can easily eject a liquid to even a very large-sized workpiece, thereby improving the productivity of a workpiece, a liquid droplet ejection method, a manufacturing method of an electro-optical device, an electro-optical device and electronic equipment.

The above-referenced object is accomplished in a first aspect of the invention by a liquid droplet ejection device ejecting a liquid from a nozzle of a head, the liquid droplet ejection device including: a table for loading the workpiece; a first shifting section capable of shifting the table in a first direction and in a second direction intersecting the first direction approximately at right angles; a plurality of carriages having the head; and a second shifting section capable of shifting each of the carriages mutually along the second direction and determining its position.

According to the construction of the first aspect of the invention, the table is for loading the workpiece. The first shifting section can shift the table in the first direction and in the second direction intersecting the first direction approximately at right angles. The plurality of carriages have the heads. The second shifting section can shift each of the carriages mutually along the second direction and determine its position.

This enables the plurality of carriages having the heads to shift by the second shifting section mutually along the second direction and to determine their positions in advance. A mutual position of each head of the plurality of carriages can be accurately determined. When the table shifts in the first direction and the second direction in a condition of being loaded with the workpiece, the heads of the plurality of carriages can draw accurately by ejecting the liquid droplet to the workpiece as the liquid is ejected from the nozzles of the heads to the workpiece.

Since the heads of the plurality of carriages can eject the liquid to the workpiece, even in case of a large-sized workpiece having a large drawing area, liquid droplet ejection work to the workpiece can be carried out in high productivity.

A second aspect of the invention, in the construction of the first aspect of the invention, is that the head has the plurality of the nozzles, the plurality of the nozzles including being arranged along the second direction.

According to the construction of the second aspect of the invention, the head has a plurality of nozzles, and the plurality of the nozzles are arranged along the second direction.

This enables, for example, the plurality of nozzles of the heads to eject respectively different types of liquid and naturally the plurality of nozzles to eject the same type of liquid. This makes it possible to carry out drawing to the workpiece rapidly.

According to the first aspect of the invention or the second aspect of the invention, a third aspect of the invention is that the second shifting section includes a stator holding each of the carriages and a needle which is provided on each of the carriages, mutually shifting the carriage along the second direction and carrying out positioning.

According to the construction of the third aspect of the invention, the stator of the second shifting section is for purposes of holding each carriage. The needle of the second shifting section is provided on each carriage. This needle is for mutually shifting each carriage with respect to the stator along the second direction and carrying out positioning.

This enables each carriage to shift by the second shifting section mutually along the second direction and to carry out positioning. A relative position of the head of each carriage can be accurately adjusted in advance.

According to the construction of the first aspect of the invention, a fourth aspect of the invention includes a maintenance section for recovering an ejection capacity of the nozzle of the head which is arranged at least at one position of the second direction.

In the construction of the fourth aspect of the invention, the maintenance section for recovering the ejection capacity of the nozzle of the head is arranged at least at one position of the second direction.

This enables the head of the carriage to permit the maintenance section to recover the ejection capacity of the nozzle only by shifting to the second direction through the second shifting section.

The object in a fifth aspect of the invention is accomplished by the liquid droplet ejection device ejecting the liquid from the nozzle of the head, the liquid droplet ejection device including a workpiece shifting process, in which a table loaded with the workpiece is shifted in the first direction and in the second direction intersecting the first direction approximately at right angles, and a liquid droplet ejection process ejecting the liquid to the workpiece from the nozzle of the head disposed on the plurality of carriages which have mutually shifted along the second direction and have been positioned in advance.

This enables the plurality of carriages having the head to shift mutually by the second shifting section along the second direction and to be positioned in advance. The mutual position of each head of the plurality of carriages can be accurately determined. Further, when the table is shifting in the first direction and the second direction in the condition of being loaded with the workpiece, the head of the plurality of carriages can draw accurately by ejecting the liquid to the workpiece as the liquid droplet is ejected from the nozzles of the head to the workpiece.

Since the head of the plurality of carriages can eject the liquid to the workpiece, even in case of a large-sized workpiece having a large drawing area, liquid droplet ejection work to the workpiece can be carried out in high productivity.

According to the construction of the fifth aspect of the invention, a sixth aspect of the invention includes the first direction which is a drawing direction in which drawing is carried out by the liquid with respect to the workpiece as the table shifts with respect to the head, and the second direction which is a line feed direction in which line feed of an ejection position of the liquid on the workpiece is made as the table shifts for a fixed amount with respect to the head.

According to a sixth aspect of the invention, the first direction is the drawing direction in which drawing is carried out by the liquid with respect to the workpiece as the table shifts with respect to the head, and the second direction which is a line feed direction in which the line feed of an ejection position of the liquid on the workpiece is made as the table shifts for the fixed amount to the head.

This enables the workpiece to be drawn on along the first direction while the line feed is being made along the second direction, thus making it possible to perform drawing easily and quickly over approximately an entire surface of the workpiece.

In the construction of the fifth aspect of the invention or the sixth aspect of the invention, a seventh aspect of the invention includes the carriage not used for ejection of the liquid droplet which shifts along the second direction to the maintenance section, and which performs recovery of the ejection capacity of the nozzle of the head in the maintenance section.

According to the construction of the seventh aspect of the invention, the carriage not used for ejection of the liquid shifts along the second direction to the maintenance section and performs recovery of the ejection capacity of the nozzle of the head in the maintenance section.

This enables the carriage not used for ejection of the liquid droplet to perform recovery of the ejection capacity of the nozzle of the head in the maintenance section only by shifting along the second direction to the maintenance section side.

The object is accomplished in an eighth aspect of the invention by a liquid droplet ejection method of ejecting the liquid from the nozzle of the head to the workpiece, the liquid droplet ejection method including a scanning process in which the table loaded with the workpiece scans in the first direction, and a liquid droplet ejection process ejecting the liquid to the workpiece from the nozzle of the head disposed on the plurality of carriages, which have shifted along the second direction intersecting the first direction approximately at right angles, and have been positioned in advance, wherein whenever the scanning process is carried out for a preset frequency, the table shifts in the second direction for the fixed amount.

This enables the table to scan in the first direction in the scanning process, so that the nozzle of the head of the plurality of carriages can eject the liquid to the workpiece in the ejection process. At this point, whenever the scanning process is carried out for the preset frequency, accurate drawing is performed by ejecting the liquid droplet to the workpiece as the table shifts in the second direction for the preset amount.

Since the head of the plurality of carriages can eject the liquid to the workpiece, even in case of a large-sized workpiece having a large drawing area, liquid droplet ejection work to the workpiece can be carried out in high productivity.

The object is accomplished in a ninth aspect of the invention by a manufacturing method manufacturing an electro-optical device by ejecting the liquid from the nozzle of the head to the workpiece, the manufacturing method of the electro-optical device including the head of the plurality of carriages which have mutually shifted along the second direction and have been positioned in advance when the table loaded with the workpiece shifts in the first direction and in the second direction intersecting the first direction approximately at right angles, and which manufactures the electro-optical device by ejecting the liquid from the nozzle of the head to the workpiece.

This enables the plurality of carriages having the head to shift mutually by the second shifting section along the second direction and to be positioned in advance. The mutual position of each head of the plurality of carriages can be accurately determined.

Further, when the table shifts in the first direction and the second direction in the condition of being loaded with the workpiece, the head of the plurality of carriages are able to draw accurately by ejecting liquid droplets to the workpiece as the liquid is ejected from the nozzle of the head to the workpiece.

Since the head of the plurality of carriages can eject the liquid to the workpiece, even in case of a large-sized workpiece having a large drawing area, liquid droplet ejection work to the workpiece can be carried out in high productivity. It is possible to draw in high productivity even in case of a large workpiece by using the head of the plurality of carriages, hence, productivity of the electro-optical device can be enhanced.

The object is accomplished in a tenth aspect of the invention by an electro-optical device manufactured by ejecting the liquid from the nozzle of the head to the workpiece, the electro-optical device including the head of the plurality of carriages which have mutually shifted along the second direction and have been positioned in advance when the table loaded with the workpiece shifts in the first direction and in the second direction intersecting the first direction approximately at right angles, and which manufactures the electro-optical device by ejecting the liquid from the nozzle of the head to the workpiece.

This enables the plurality of carriages having the head to shift mutually by the second shifting section along the second direction and to be positioned in advance. The mutual position of each head of the plurality of carriages can be accurately determined.

Further, when the table shifts in the first direction and the second direction in the condition of being loaded with the workpiece, the head of the plurality of carriages can draw accurately by ejecting the liquid droplet to the workpiece as the liquid is ejected from the nozzle of the head to the workpiece.

Since the head of the plurality of carriages can eject the liquid to the workpiece, even in case of a large-sized workpiece having a large drawing area, liquid droplet ejection work to the workpiece can be carried out in high productivity.

It is possible to draw in high productivity even in case of a large workpiece by using the head of the plurality of carriages, hence, productivity of the electro-optical device can be enhanced.

An eleventh aspect of the invention includes loading the electro-optical device of the tenth aspect of the invention. This provides for improvement of the productivity of electronic equipment.

BRIEF DESCRIPTION OF THE DRAWINGS

The invention will be described with reference to the accompanying drawings, wherein like numbers reference like elements.

DESCRIPTION OF THE EMBODIMENTS

Preferred embodiments of the invention will be described below with reference to the drawings.

Figure 1:
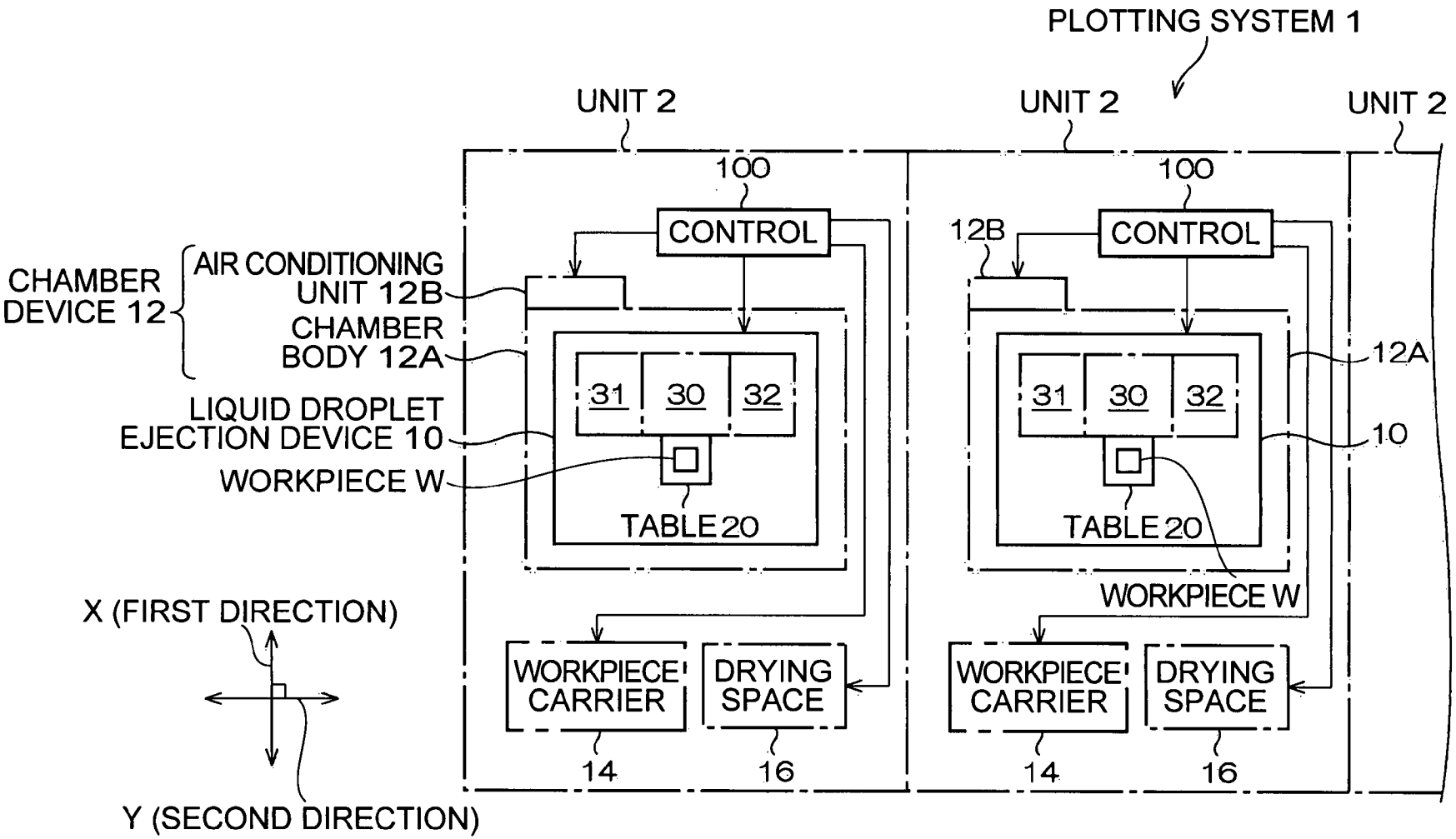
FIG. 1 is a plan view showing a structural example of a drawing system including a liquid droplet ejection device of the invention.

FIG. 1 is a plan view showing an example of a drawing system including a preferred embodiment of a liquid droplet ejection device of the invention.

A drawing system shown in FIG. 1 includes a plurality of units 2. In FIG. 1, for the sake of simplifying illustrations, three units 2 are shown. However, the number of units 2 may be more than 4 or 1 or 2.

This drawing system is, as an example, one kind of a so-called flat panel display, such as what is incorporated in a production line of an organic EL (electroluminescence) device. This liquid droplet ejection device 10 can form, for instance, a light emitting device which becomes each pixel of the organic EL device.

Each unit 2 shown in FIG. 1 assumes the same shape. The unit 2 comprises a liquid droplet ejection device 10, a chamber device 12, a workpiece carrier 14, a drying space 16, and a control 100. The liquid droplet ejection device 10 is a device for ejecting the liquid to a workpiece W.

The chamber device 12 is constituted by a chamber proper 12A and an air conditioning unit 12B. The chamber 12A accommodates a liquid droplet ejection device 10. The air conditioning unit 12B is designed to perform temperature control inside the chamber proper 12A under a fixed temperature condition. The chamber proper 12A is a so-called thermal chamber. This enables the liquid droplet ejection device 10 in the chamber proper to perform drawing operation which may also be called liquid droplet ejection (liquid ejection) work to the workpiece W under a fixed temperature environment.

The workpiece carrier 14 of FIG. 1 is a unit for carrying the workpiece W to be drawn on to the table 20 from outside the unit 2, or carrying the workpiece on the table 20 to outside the unit 2. The drying space 16 is a dryer for drying, depending on the condition, a liquid solvent ejected to the workpiece W. A liquid ejected by the liquid droplet ejection device 10 may also be called a functional liquid.

The liquid droplet ejection device 10, for example, can be used as an inkjet drawing device. The liquid droplet ejection device 10 is, for example, for forming a light emitting device of an organic EL device by a liquid ejection method (inkjet method). A head of the liquid droplet ejection device 10 (also referred to as a "functional liquid droplet ejection head) can form a light emitting device of an organic EL device Specifically, by scanning relatively a head, to which a light emitting functional material is introduced, with respect to a substrate (an example of a workpiece) on which a bank is formed through a bank forming process and a plasma processing process in a manufacturing method of the organic EL device, the liquid droplet ejection device 10 can form a film-making part of a hole injection/transport layer and the light emitting layer corresponding to a position of a pixel electrode of the substrate.

For example, by having two units of the liquid droplet ejection device 10 ready, a first unit of the liquid droplet ejection device 10 forms the hole injection/transport layer while another adjacent unit of the liquid droplet ejection device 10 can form the light emitting layers of three colors of R (red), G (green), and B (blue).

Next, a structural example of the liquid droplet ejection device 10 shown in FIG. 1 will be described with reference to FIG. 2 and FIG. 3.

The liquid droplet ejection device 10 comprises a liquid droplet ejection section 30, one and the other maintenance sections 31 and 32, a table 20, a first shifting section 41, a second shifting section 42, a plurality of carriages 50, and a bed 45. In FIG. 2 and FIG. 3, an x direction, a y direction, and a z direction are illustrated.

The x direction is a first direction, the y direction is a second direction, and the z direction is equivalent to a third direction. The x direction and the y direction are on a surface 45A of the bed 45, and the z direction is a direction which mutually intersects the x direction and the y direction at right angles. It is desirable for the y direction to intersect the x direction approximately at right angles or at right angles.

Figure 2:
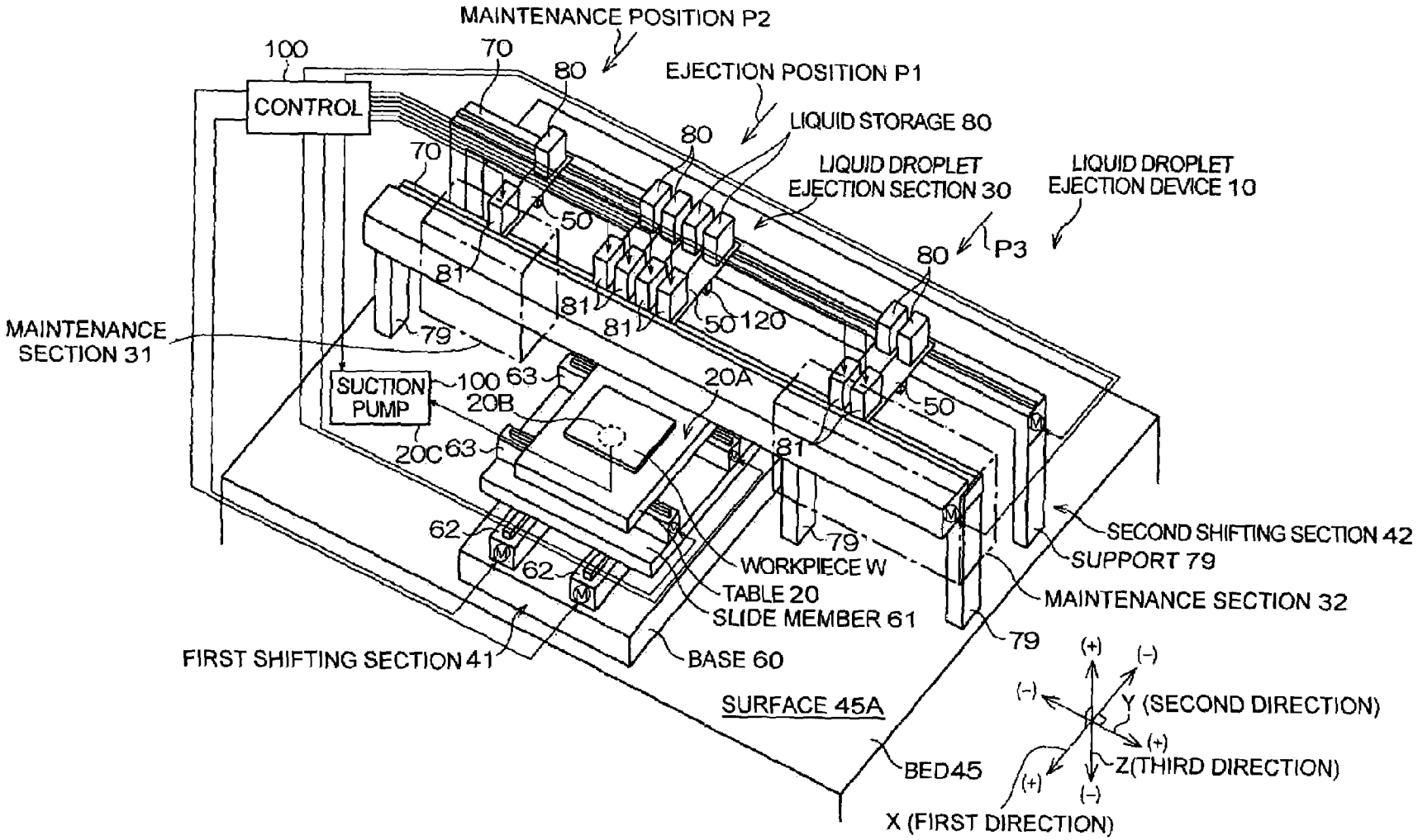
FIG. 2 is a perspective view showing a structural example of the liquid droplet ejection device shown in FIG. 1.
Figure 3:
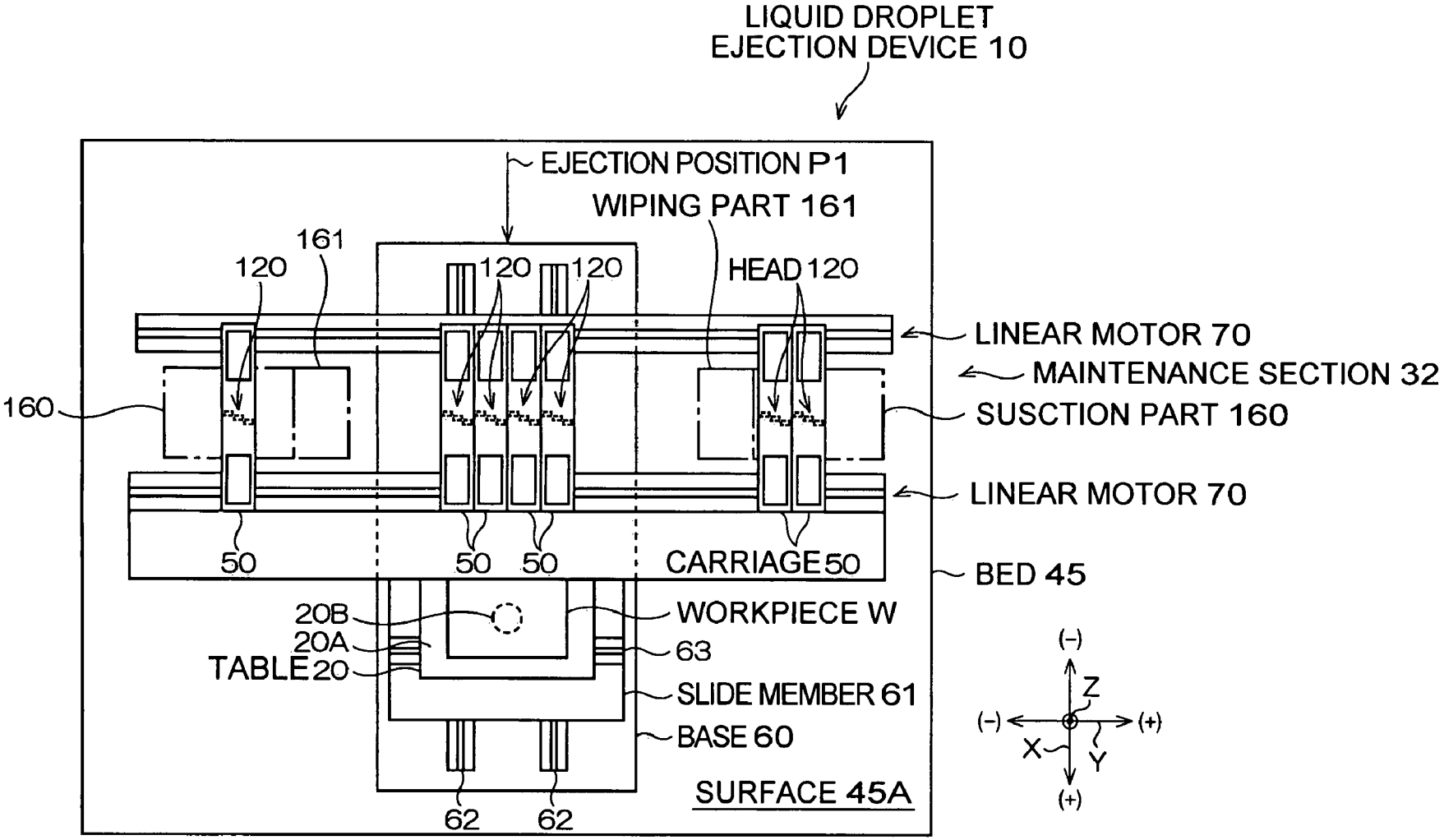
FIG. 3 is a plan view of the liquid droplet ejection device of FIG. 2.

A table 20 shown in FIG. 2 and FIG. 3 is a member of a flat plate shape holding the workpiece W detachably. The table 20 has a loading surface 20A of the workpiece W. The loading surface 20A has a sucking part 20B. This sucking part 20B is coupled to a suction pump 20C. When a control 100 operates the suction pump 20C, the suction pump 20C sucks the workpiece detachably through the suction part 20B and holds the loading surface 20A. This enables the workpiece W to be detachably fixed securely without slipping off the loading surface 20A.

The workpiece W in FIG. 2 is, for example, a relatively large-sized glass substrate. The table 20 can be positioned by the first shifting section 41 as it shifts respectively in the x direction and the y direction. Consequently, the first shifting section 41 includes a base 60, a slide member 61, a set of linear motors 62 and 62 and another set of linear motors 63 and 63.

The base 60 in FIG. 2 is fixed on the surface 45A of the bed 45. On the base 60 are fixed the linear motors 62 and 62 in parallel along the x direction. A slide member 61 can be positioned by shifting along the x direction through operation of the linear motors 62 and 62. The linear motors 63 and 63 can be positioned by shifting the table 20 along the y direction.

This enables the table 20 loaded with the workpiece W to be positioned by shifting respectively along the x direction and the y direction. Each of the linear motors 62 and 63 operates according to instructions respectively from the control 100. As shown in FIG. 3, the linear motors 62 and 62 are placed along the x direction, while as shown in FIG. 3, the base 60 and the linear motors 62 and 62 are placed underneath a lower part of the second shifting section 42.

Next, the second shifting section 42 will be described.

The second shifting section 42 is placed, as shown in FIG. 2 and FIG. 3, in a direction intersecting the first shifting section 41 at right angles. Further, the second shifting section 42 is placed apart from the first shifting section 41 in relation to the z (+) direction. The second shifting section 42 makes it possible to determine positioning as each carriage 50 is mutually shifted along the y direction.

The second shifting section 42 has a set of linear motors 70 and 70 and a plurality of supports 79. The linear motors 70 and 70 of the second shifting section 42 are positioned in parallel at a preset gap along the y direction, each being supported horizontally at an upper part of the bed 45 by the supports 79.

The plurality of carriages 50 can be positioned by mutually shifting freely at a preset gap along the y direction by the linear motors 70 and 70. In examples of FIG. 2 and FIG. 3, seven units of the carriage 50 can be positioned by mutually shifting freely in the y direction. Use of the plurality of carriages 50 in this manner is for improving productivity in the manufacturing process of the workpiece W through drawing on the workpiece by setting up such that the liquid droplets can be ejected in a short time to the large-sized workpiece W.

Figure 4A:
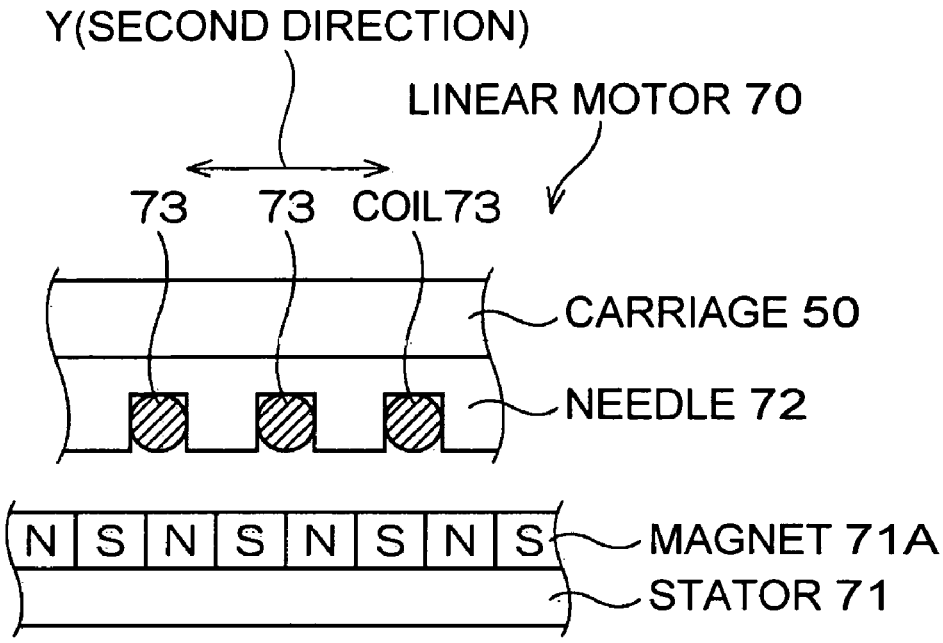
FIGS. 4A and B show diagrams of structural examples of a linear motor.

FIG. 4A shows a structural example of the linear motor 70 shown in FIG. 2. The linear motor 70 has a stator 71 and a needle 72. The stator 71 is held on a support 79 side as shown in FIG. 2. On the other hand, the needle 72 is provided on each carriage 50. By running a current through a coil 73 of the needle 72, through mutual action of magnetism generated by the coil 73 and a magnetic field generated by an S pole and an N pole of a magnet 71A, the needle 52 can be positioned by shifting mutually independently along the y direction (second direction).

Figure 4B:
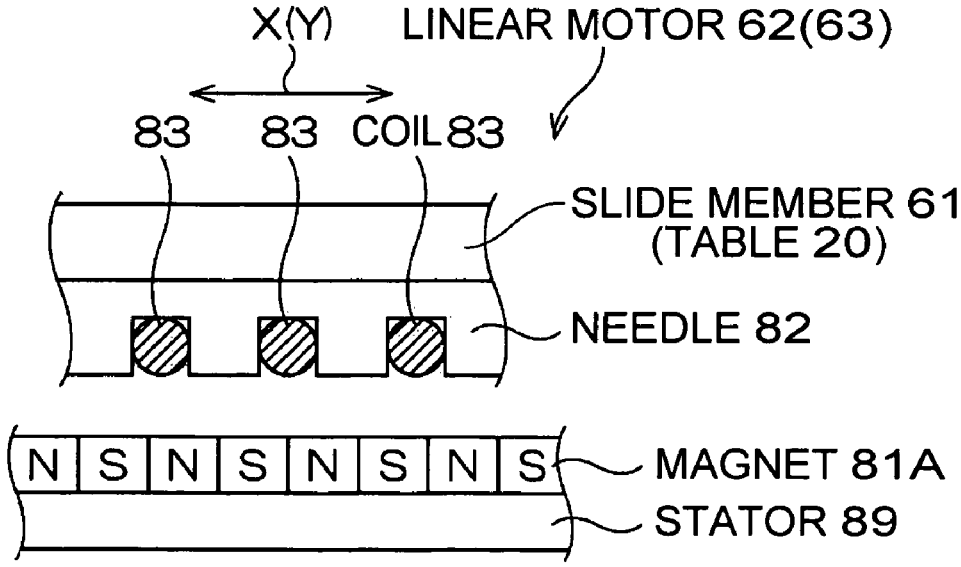

FIG. 4B shows a structural example of the linear motors 62 and 63 shown in FIG. 2. In case of the linear motor 62, it has a stator 89 and a needle 82. The stator 89 has a magnet 81A. This stator 89 is fixed to the base 60. The needle 82 is provided on a slide member 61 side.

By running a current through a coil 83 of the needle 82, through mutual action of magnetism generated by the coil 83 and a magnetic field generated by the S pole and the N pole of the magnet 81A, a slide member 61 can be positioned by shifting along the x direction (first direction).

Further, in case of the linear motor 63 shown in FIG. 4B, the stator 89 is fixed on the slide member 61. The needle 82 is fixed to the table 20 side.

By this, through running a current in the coil 83, it is possible to position the table 20 by shifting along the y direction (second direction) with respect to the slide member 61.

Structures of the linear motors 70, 62, and 63 shown in FIG. 4 are one example and not limited to these. It is naturally possible to employ other structures.

Next, structural examples of the carriages 50 shown in FIG. 2 and FIG. 3 will be described with reference to FIG. 5.

Each carriage 50 has the same structure. Each carriage 50 has a liquid storage 80 and an electronic unit 81. The liquid storage 80 stores a functional liquid to be supplied to the head of the carriage 50. The electronic unit 81 drives a piezo-electric element by supplying a voltage to the piezo-electric element of the head of the carriage 50 according to instructions of the control 100. This enables this liquid to be ejected from a nozzle corresponding to the piezo-electric element.

Figure 5:
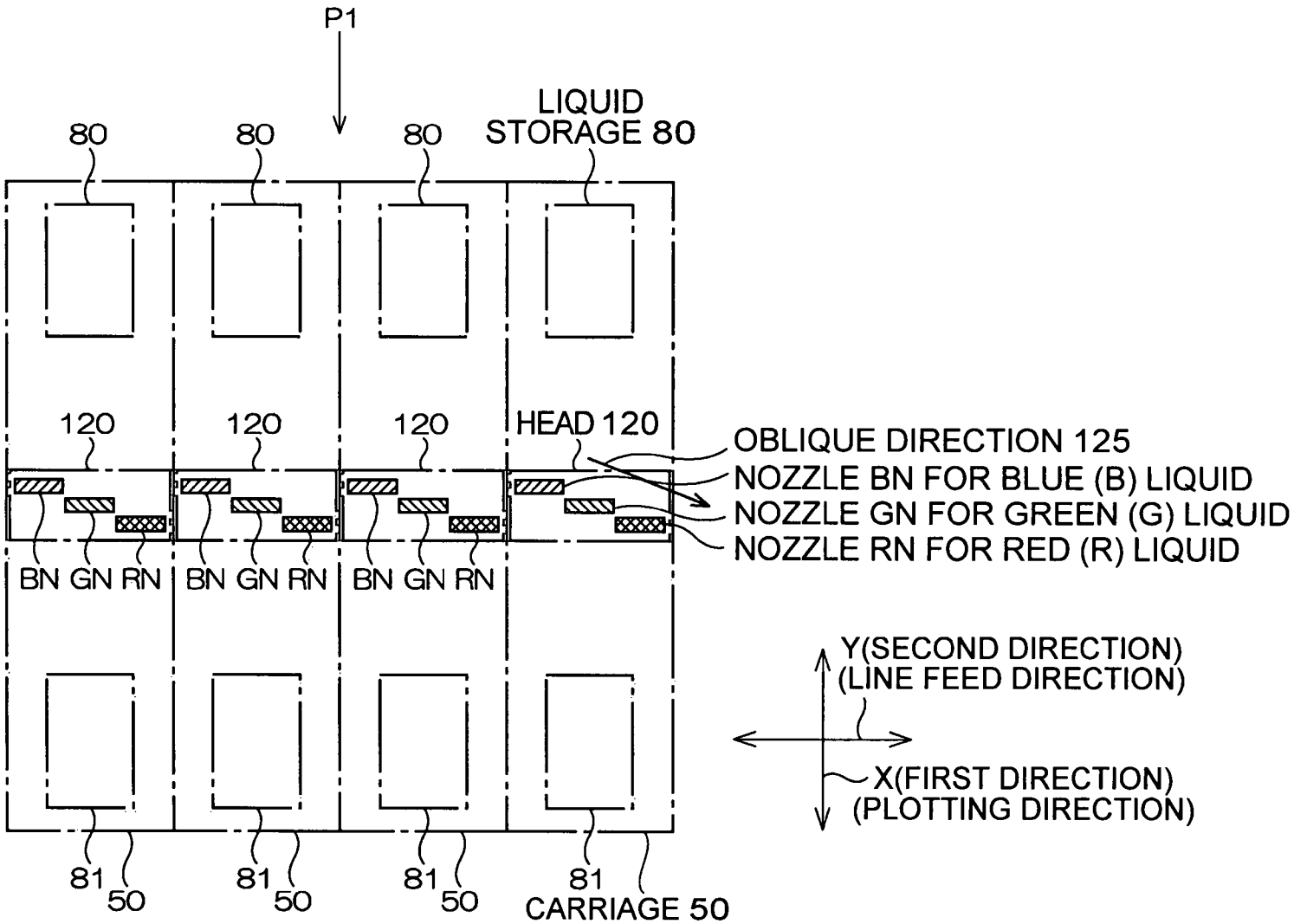
FIG. 5 shows a diagram of an arrangement example of carriages and heads.

FIG. 5 shows structural examples of, for example, four carriages 50 which are positioned at an ejection position P1 shown in FIG. 2. In FIG. 2, in addition to the ejection position P1, there are maintenance positions P2 and P3. The structure of the carriage 50 positioned at each position is entirely the same.

Now, regarding the four carriages 50 positioned at the ejection position P1 shown in FIG. 5, its typical structural example will be described. On an upper surface side are mounted the above-referenced liquid storage 80 and the electronic unit 81. On a central part of the carriage 50 and on its lower surface side, a head 120 is mounted. This head 120 may also be referred to as an ejection head of a functional liquid or an inkjet head.

Each head 120 is provided with a plurality of nozzles, for example, having nozzle groups RN, GN, and BN. While each nozzle group is constituted by a plurality of nozzles, a case of one nozzle is included as well. The nozzle group RN includes nozzles, for example, for ejecting a red liquid, the nozzle group GN includes nozzles, for example, for ejecting a green (G) liquid, and the nozzle group BN includes nozzles, for example, for ejecting a blue (B) liquid.

In FIG. 5, the nozzle group RN is shown in meshes, the nozzle group GN is shown in hatching that slopes down to the right, and the nozzle BN is shown in hatching that slopes up from left to right.

Arrangement directions of the nozzle groups RN, GN, and BN in each head 120 are along approximately the y direction. However, in this example, each of the nozzle groups RN, GN, and BN is arranged along an oblique direction 125 which is a synthesis of the x direction and the y direction. Each head 120 is provided on a lower surface side of the carriage 50, that is, on a side facing the workpiece W. This enables the head 120 to face the workpiece W and to be positioned above the workpiece W.

Next, left and right maintenance sections 31 and 32 shown in FIG. 2 and FIG. 3 will be described.

The maintenance sections 31 and 32 are arranged on the right side of the first shifting section 41 and on the left side of the first shifting section 41. The left and right maintenance sections 31 and 32 are arranged along the y direction with a gap in between.

These maintenance sections 31 and 32 are constructed such as to be arranged inside the supports 79 of the second shifting section 42, thus keeping the maintenance sections 31 and 32 from being outside the supports 79 and outside the bed 45. This makes it possible to miniaturize the liquid droplet ejection device 10.

If the carriage 50 is not used for ejecting liquid droplets to the workpiece W, as for the carriage 50 not used, for example, the maintenance section 31 or the maintenance section 32 can realize recovery of the ejection capacity of the functional liquid in each nozzle of the head 120.

If maintenance of the nozzle of the head 120 is performed in this manner, all that is required is for the carriage 50 to be positioned by shifting in the y direction from the liquid droplet ejection section 30 or from the ejection position P1 along the maintenance position P2 or the maintenance position P3.

Figure 6A:
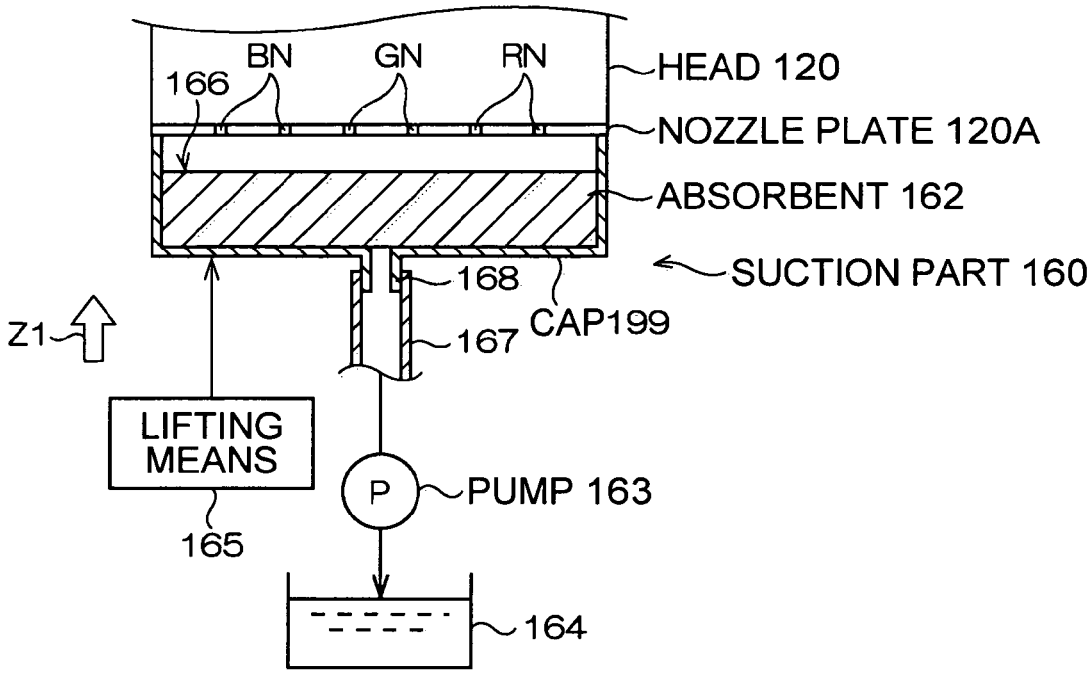
FIGS. 6A and B show diagrams of structural examples of a maintenance section.
Figure 6B:
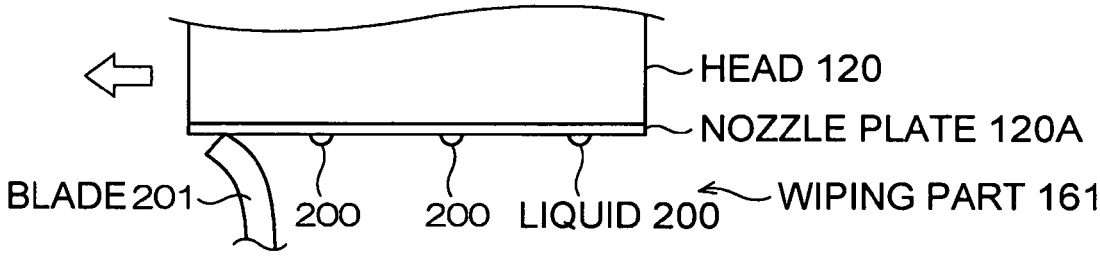

Structural examples of the maintenance sections 31 and 32 will be described with reference to FIG. 6.

As shown in FIG. 3, the maintenance sections 31 and 32 respectively include a suction part 160 and a wiping part 161. The suction part 160 includes a cap 199, an absorbent 162, a pump 163, and a waste liquid tank 164. The cap 199 can seal each nozzle of a nozzle plate 120A by sticking it fast to the nozzle plate 120A of the head 120. The absorbent 162, being accommodated in the cap 199, has a function of absorbing a liquid to be sucked.

The cap 199 can seal the nozzle plate 120A of the cap 199 as it is lifted by a lift 165 in a z1 direction. The cap 199 has an opening 166 on its upper part.

When the control 100 operates the pump 163, the pump 163 produces a negative pressure inside the cap 199 through tubes 167 and 168. This makes it possible to suck any liquid and air bubble inside the nozzles of the head 120 into the absorbent 162 side, which are collected on the waste liquid tank 164 side. By this, what clogs up inside the nozzles of the head 120 due to drying, air bubbles and the like are sucked to realize recovery of the ejection capacity of the nozzles of the head.

Thereafter, the wiping part 161 is used to wipe off a liquid 200 deposited on the nozzle plate 120A. The wiping part 161 can wipe off the liquid 200 deposited on the nozzle plate 120A, for example, by relatively contacting a blade 201 and shifting it to the nozzle plate 120A.

In the manner described above, as the head 120 is wiped off by the blade after suction, it is possible to realize recovery of the ejection capacity of the head 120.

In addition, the maintenance sections 31 and 32 may have a flushing unit, an ejection checking unit, or a weight measuring unit. The flushing unit is for receiving an ejected liquid ejected preliminarily by the head 120. The ejection checking unit checks an ejection condition of the liquid ejected from the head 120. The weight measuring unit measures a weight of the liquid ejected by the head 120.

Next, a preferred embodiment of a liquid droplet ejection method of the invention will be described while referring to FIG. 7 to FIG. 10.

Figures 7A, 7B, 7C:
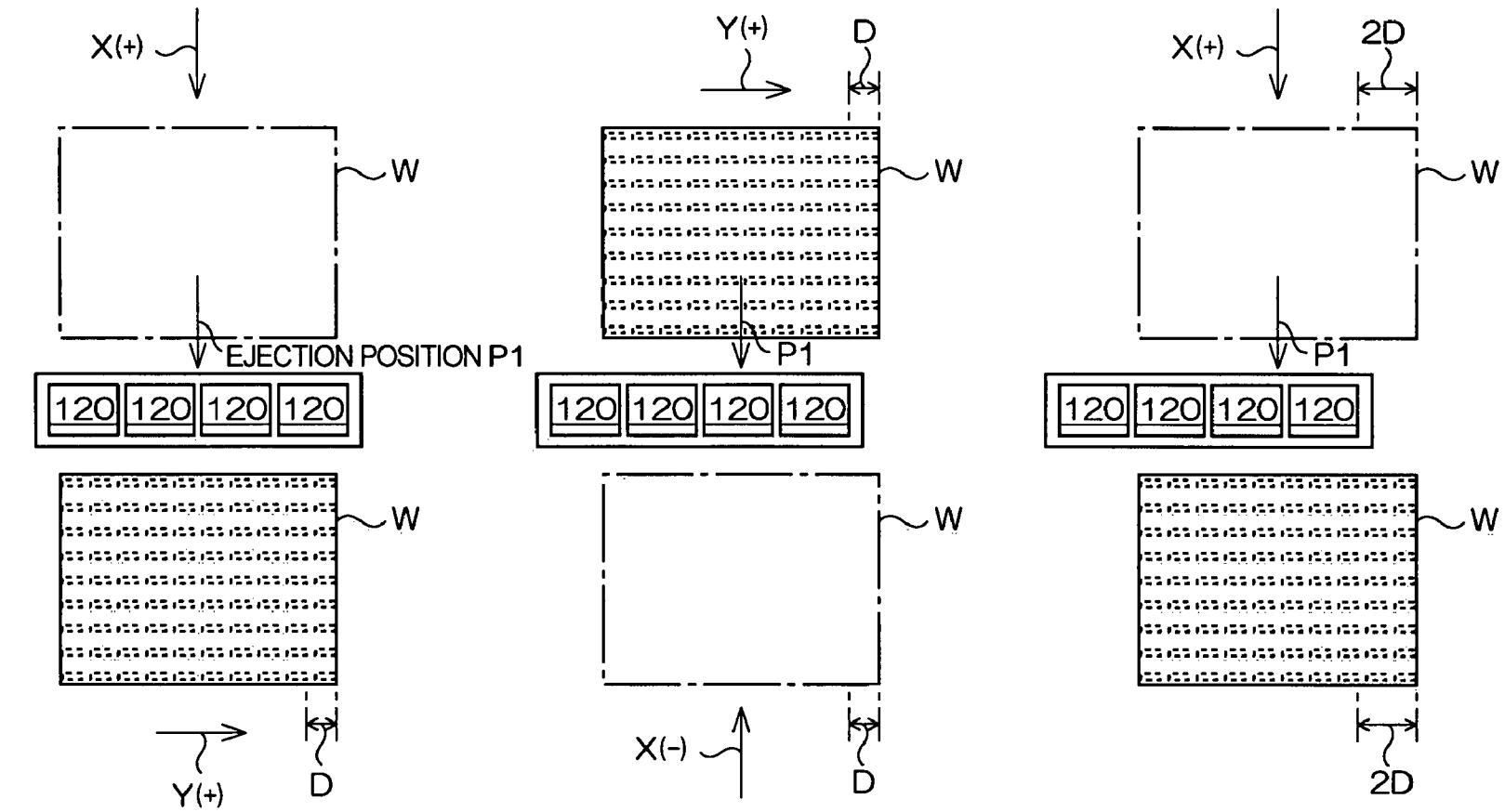
FIGS. 7A-C show diagrams illustrating first time to third time statuses of drawing finish.

FIG. 7 schematically shows a liquid droplet ejection method for drawing three kinds of liquid (R, G, and B) with respect to the workpiece W. FIG. 7A shows a condition in which a first time drawing ejection is completed by shifting the workpiece W in an x(+) drawing direction. FIG. 7B shows a condition in which a second time drawing ejection is completed after line feed is carried out for the workpiece W in a line feed y(+) direction and then the workpiece W is shifted to an x(−) drawing direction.

FIG. 7C shows a condition in which after the workpiece W is shifted to a line feed y(+) direction, the workpiece W is again shifted to the x(+) direction to complete a third time drawing ejection.

After the first time drawing is completed in FIG. 7A, the workpiece W, together with the table, is subjected to line feed only for a fixed amount D in the y(+) direction. In FIG. 7B, too, after the second time drawing is completed, the workpiece W, together with the table, is subjected to line feed only for the fixed amount D in the y(+) direction.

In FIG. 7, four heads 120 shown in FIG. 5 are presented in simplified formats. For example, four carriages 50 are positioned at the ejection position P1 in advance as shown in FIG. 5 and FIG. 2. A mutual gap between each carriage 50 can be adjusted in advance such that each head 120 has a proper gap mutually by slightly shifting each carriage 50 in the y direction. This enables a gap between nozzles of each head 120 to be accurately positioned in advance along the y direction and ejection precision in ejecting from each nozzle to the workpiece to be maintained.

In the embodiment of the liquid droplet ejection method of the invention, a process of shifting a table loaded with the workpiece in the x direction (first direction) and the y direction (second direction) is referred to as a workpiece shifting process. A process of scanning the table loaded with the workpiece in the x direction is called a scanning process. The y direction is either intersecting the x direction at right angles or approximately at right angles.

Further, a process of ejecting a liquid to the workpiece from nozzles of heads disposed on a plurality of carriages positioned in advance along the y direction is called a liquid ejection process or an ejection process.

Figure 8A:
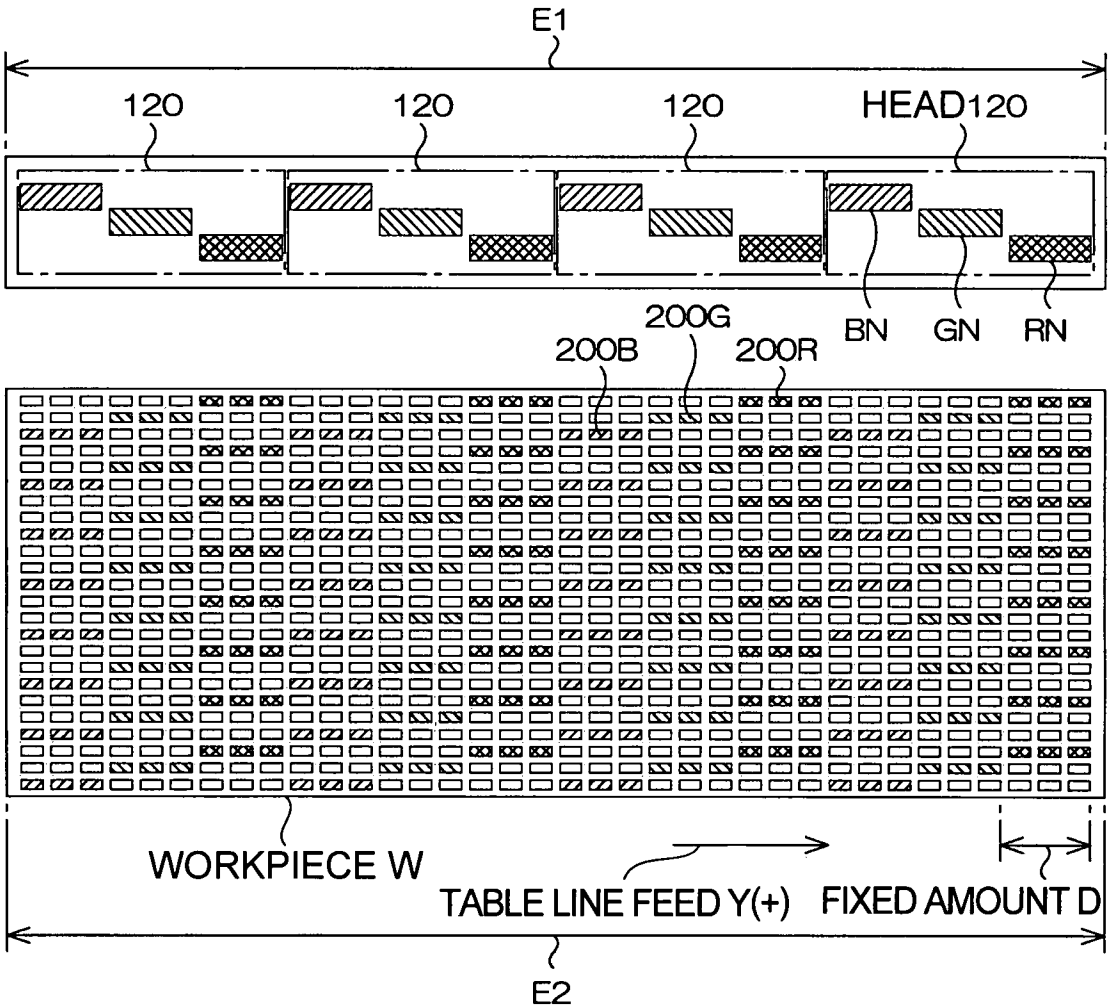
FIG. 8A is a diagram showing the first time status of drawing finish in more detail.

FIG. 8 shows more specifically a status after finishing first time drawing shown in FIG. 7A. The nozzle group RN of each head 120 is shown in meshes, the nozzle group GN is shown in slashes that slope down to right, and the nozzle group BN is shown in slashes that slope up from left to right.

Further, to distinguish drawing portions of the liquid drawn on the workpiece, the drawing portions of the liquid ejected from the nozzle group RN are shown by 200R, the drawing portions of the liquid ejected from the nozzle group GN are shown by 200G, and the drawing portions of the liquid ejected from the nozzle group BN are shown by 200B.

As shown in FIG. 8 and FIG. 7A, for example, a total arrangement width E1 of the four heads 120 approximately corresponds to a width E2 of the workpiece W. The four heads 120 are positioned at the positions corresponding to the workpiece W. In FIG. 3, the four carriages 50 are positioned in advance so that their positions are fixed motionless in the y direction.

The first shifting section 41 shown in FIG. 2 is such that by shifting the table 20, together with the slide member 61, as shown in FIG. 7A, in the x(+) drawing direction, the workpiece W passes from under a position shown in one-dot chain lines through under the four heads 120. This makes it possible for each head 120 of each of the nozzle groups RN, GN, and BN to draw respectively the drawing portions 200R, 200G, and 200B of the liquid at preset positions. FIG. 8 and FIG. 7A show a finish status of first time drawing.

Next, in FIG. 8 and FIG. 7A, the workpiece W, together with the table, is subjected to line feed only for the fixed amount D in the y(+) direction. In other words, together with the table 20 shown in FIG. 3, the workpiece W performs line feed shifting for the fixed amount D in the y(+) line feed direction.

Further, as shown in FIG. 7B, as the workpiece W shifts again, together with the table 20, the workpiece W passes from the position of one-dot chain lines in the x(+) drawing direction, the workpiece W passes underneath the four heads 120. This makes it possible for each head 120 of the nozzle group RN to eject the drawing portion 200R of the liquid, the nozzle group GN at a position slipped off by the fixed amount D to eject the drawing portion 200G of the liquid, and the nozzle group BN to eject the drawing portion 200B of the liquid.

Figure 9B:
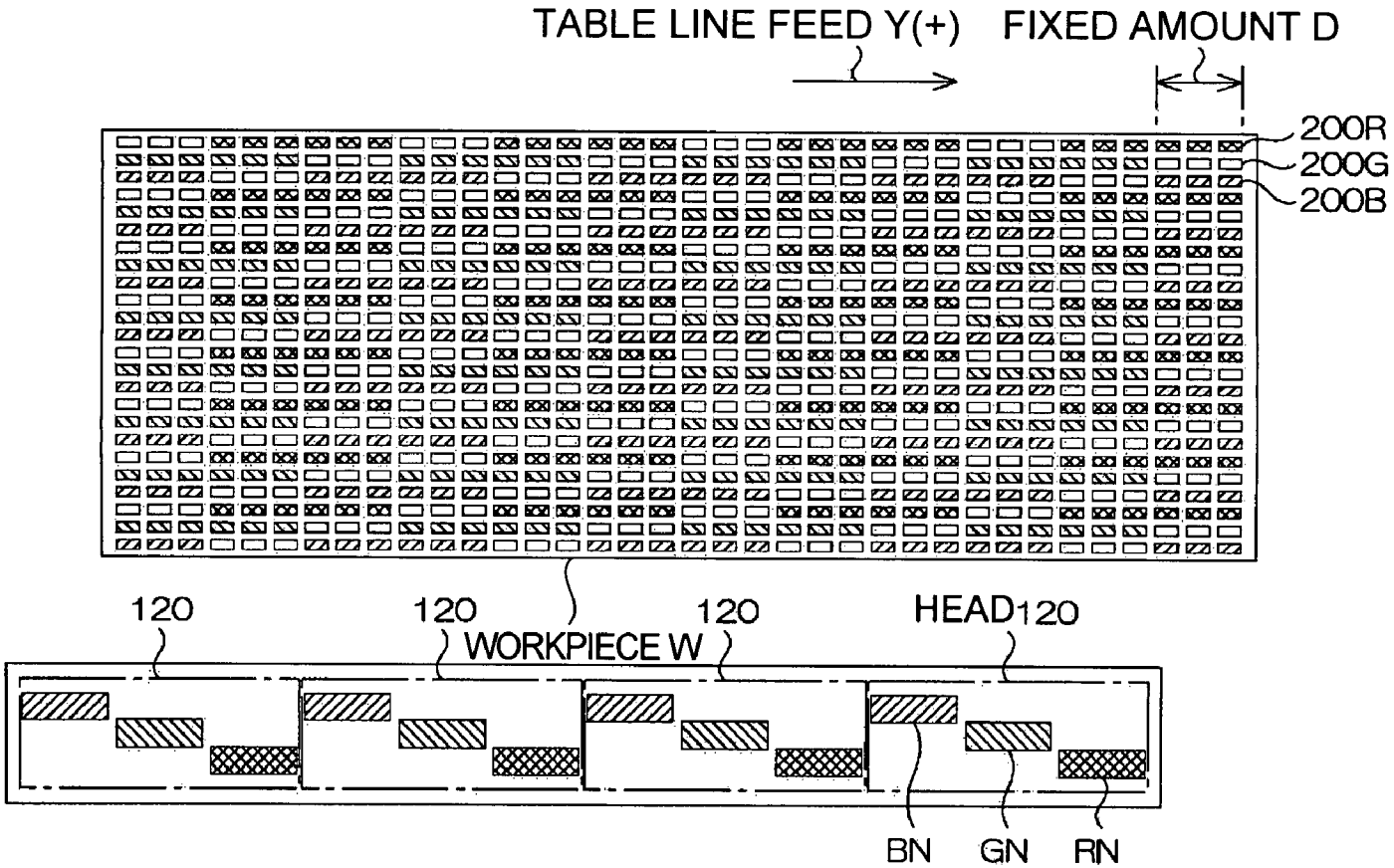
FIG. 9B is a diagram showing the second time status of drawing finish in more detail.

In this manner, the second time drawing is finished as shown in FIG. 9.

Thereafter, the workpiece W further performs second time line feed shifting, together with the table 20. The workpiece W of FIG. 7C performs line feed shifting again for the fixed amount D in the y(+) line feed direction.

Figure 10C:
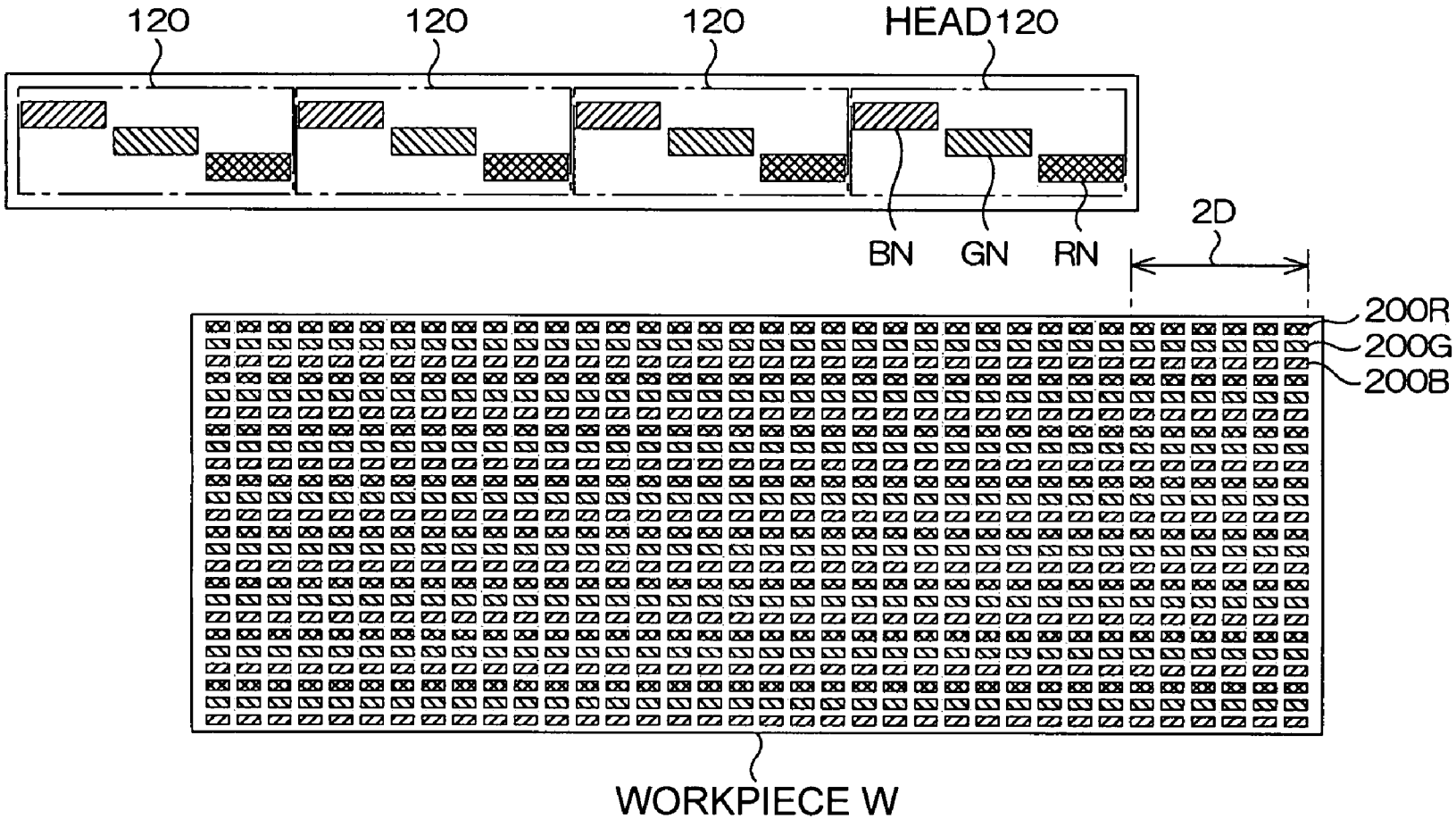
FIG. 10C shows diagrams of the third time status of drawing finish in more detail.

Then, as shown in FIG. 7C and FIG. 10, the workpiece W, by shifting again in the x(+) drawing direction, shifts from the position of one-dot chain lines to under the four heads 120. As a result, as shown in FIG. 7C and FIG. 10, third time drawing can be performed. This enables the liquid 200R, 200G, and 200B to be drawn over the entire area and a 3-color light-emitting layer of R, G, and B to be formed. In the status shown in FIG. 7C and FIG. 10, the total amount of line feed is 2D.

In the examples of FIG. 2 and FIG. 3, in the ejection position P1, for example, the four carriages 50 are arranged side by side. The remaining three carriages 50 not used for ejection work are split into one and two so that the left and right maintenance sections 31 and 32 can perform maintenance.

The number of carriages 50 to be used depends on the size (area) of the workpiece W and is not limited to four. Of course, it may be more than one and less than three or more than five and less than seven. Moreover, it is naturally possible to be put to use by loading more than seven carriages 50.

The head 120 provided on each carriage 50 is not limited to the three nozzle groups of RN, GN, and BN as shown in FIG. 5. It may naturally be two or more than four. The arrangement direction of each nozzle may be formed along the y direction or formed along the x direction. Further, naturally, it may be arranged along a composite direction of the x direction and the y direction.

In the embodiment of the invention, to shift the table 20 in the x direction and the y direction, the linear motors 62 and 63 are employed. Further, to shift a plurality of carriages 50 in the y direction in a manner that enables gaps to be mutually altered, a linear motor 70 is likewise used.

Nevertheless, in lieu of the linear motor, a normal feed mechanism constructed by using a motor, a feed screw and a nut may naturally be used.

In the embodiment of the invention, a plurality of carriages 50 having the heads 120 may be positioned by mutually shifting along the second direction (y) through the second shifting section 42.

This enables the mutual position of each head of the plurality of carriages to be positioned in advance accurately. When the table 20, in the condition of being loaded with the workpiece W, shifts in the first direction (x) and the second direction (y), the heads of the plurality of carriages can draw by ejecting liquid droplets to the workpiece as the liquid is ejected from the nozzles of the heads to the workpiece.

Since the heads of the plurality of carriages can eject the liquid to the workpiece, the number of carriages can be selected according to the area of the workpiece. Even in case of a large-sized workpiece having a large drawing area, liquid droplet ejection work to the workpiece can be accomplished in high productivity.

Further, since the plurality of carriages can also shift in the second direction (y) in the embodiment of the invention, when drawing with respect to the workpiece, the carriages may be shifted in the second direction (y) instead of shifting the table in the second direction (y). In this case, if the number of carriages to shift is plural, positioning may take time when shifting, and it may take more time than the case of shifting only the table 20. Consequently, depending on the number of carriages to be used, it is possible to select shifting either the table 20 or the carriages in the second direction.

It should be noted that when shifting the carriages, due to vibration, pressure fluctuation and the like affecting the liquid existing on the carriage such as a passage including inside the head and the liquid storage or vibration affecting the carriage and the like, a malfunction may be generated such as scattering of impacting positions as a result of a flying curve of the liquid droplet at the time of ejection as well as fluctuation of an ejection amount.

On the other hand, when drawing by shifting the table 20 in the first direction (x) and the second direction (y), there is no such malfunction, and drawing can be performed in better precision and stably than shifting the carriages when changing the drawing position. Therefore, this is desirable.

In the embodiment of the invention, for example, a plurality of nozzles of the head can eject respectively different kinds of liquid, and it is naturally possible for the plurality of nozzles to eject the same kind of liquid. This enables drawing with respect to the workpiece more quickly.

Further, the kind of liquid ejected per plurality of heads can be changed, thus making it possible to manage liquid supply and head maintenance easily because liquid management can be performed per head.

In the embodiment of the invention, the head 120 of the carriage 50 can recover the ejection capacity of the nozzle through the maintenance section by only shifting in the second direction (y) through the second shifting section 42.

In the embodiment of the invention, it is possible to draw on the workpiece along the first direction (x) while performing line feed along the second direction (y).

In the examples of FIG. 2 and FIG. 3, the maintenance sections 31 and 32 are arranged on both sides of the ejection position P1. However, it is not limited to this. So long as the maintenance section is set up at least on one side along the y direction, it is acceptable. For example, the maintenance section may be arranged on either side of the left side or the right side of the ejection position P1.

The embodiment of the liquid droplet ejection device of the invention can be employed for manufacturing an electro-optical device. As this electro-optical device, there may be considered a liquid crystal display, an organic EL (Electro-Luminescence) device, an electron emission device, a PDP (Plasma Display Panel) device, an electrophoretic display and the like.

Further, the electron emission device is a concept which includes a so-called FED (Field Emission Display). Furthermore, as the electro-optical device, there may be considered all sorts of devices including metallic wiring formation, lens formation, photoresist formation, and photodiffusion material formation.

Figure 11:
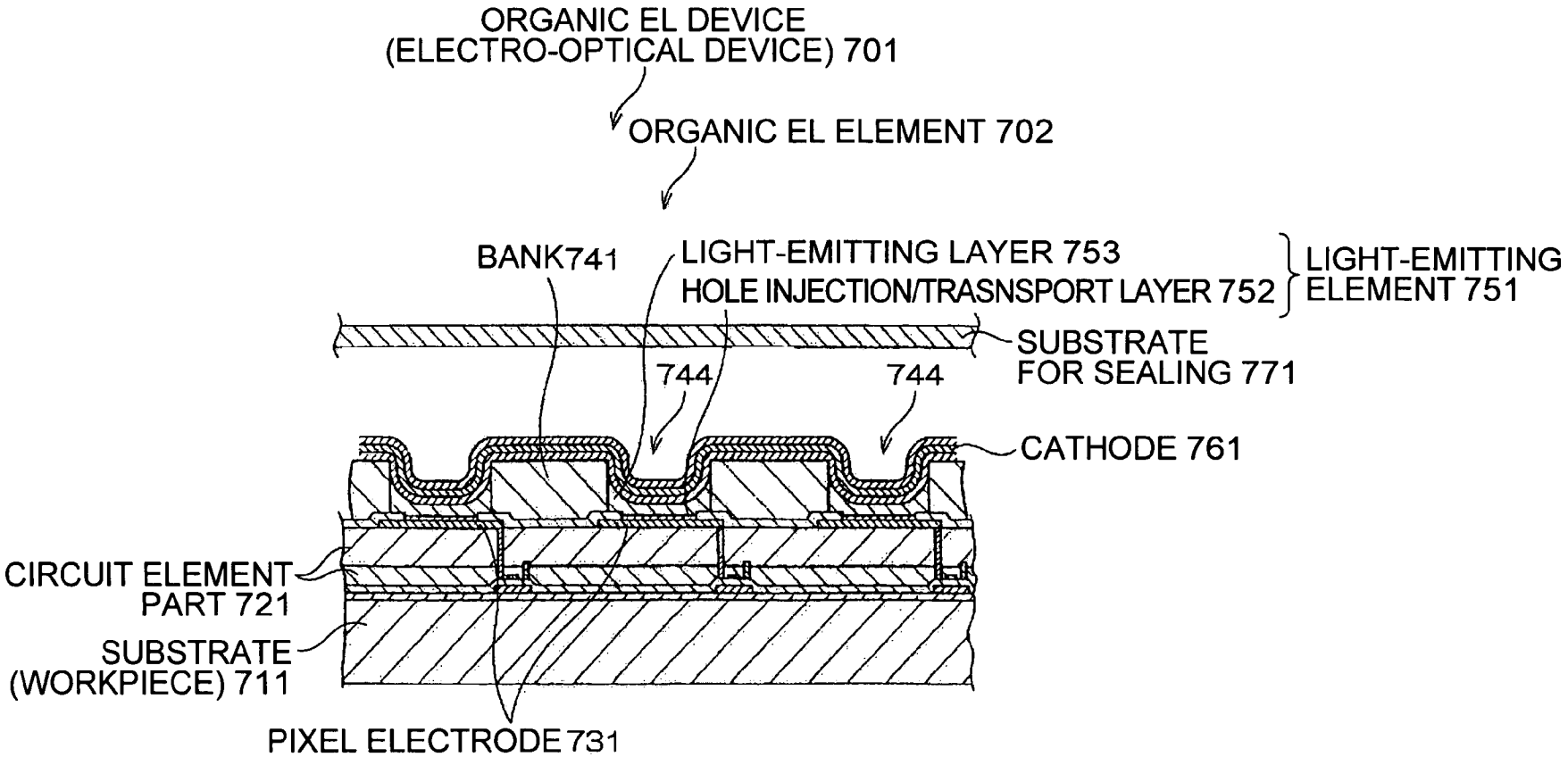
FIG. 11 is a sectional view showing an example of a shape of an organic EL device manufactured by the liquid droplet ejection device of the invention.

FIG. 11 shows a structural example of an organic EL device used in manufacturing an organic EL device, which is one kind of flat-panel display, by using the liquid droplet ejection device of the invention as a drawing device.

An organic EL device 701 is an organic EL element 702 including a substrate 711, a circuit element part 721, a pixel electrode 731, a bank 741, a light emitting device 751, a cathode 761 (opposite electrode), and a substrate for sealing 771, to which wiring of a flexible substrate (illustration omitted) and a drive IC (illustration omitted) are connected.

On the substrate 711 of the organic EL element 702, there is formed the circuit element part 721, and on the circuit element part 721, there are arranged a plurality of pixel electrodes 731. Between each pixel electrode 731, the bank 741 is formed in a grid shape, and the light emitting device 751 is formed on a concave opening 744 generated by the bank 741. On the entire surface of the bank 741 and the light emitting device 751, there is formed the cathode 761. Over the cathode 761, the substrate for sealing 771 is layered.

The manufacturing process of the organic EL element 702 includes a bank forming step forming the bank 741, a plasma processing step for properly forming the light emitting device 751, a light emitting device forming step forming the light emitting device 751, an opposite electrode forming step forming the cathode 761, and a sealing step layering the substrate for sealing 771 over the cathode 761 and sealing.

Namely, the organic EL element 702 is manufactured as follows: after the bank 741 is formed at the preset position of the substrate 711 (workpiece W) on which the circuit element part 721 and the pixel electrode 731 have been formed in advance, plasma processing, the light emitting device 751, and the cathode 761 (opposite electrode) are formed in order; further, the substrate for sealing 771 is layered over the cathode 761 and sealed.

It should be noted that because the organic EL element 702 tends to deteriorate as a result of being affected by water content in the atmosphere, it is preferable to manufacture the organic EL element 702 in dry air or in an inert gas atmosphere (nitrogen, argon, helium and the like).

Further, each light emitting device 751 is constituted by a film-making part which includes a hole injection/transport layer 752 and a light-emitting layer 753 colored in any of the colors of R (red), G (green), and B (blue). In the light emitting device forming step, there are included a hole injection/transport layer forming step which forms the hole injection/transport layer 752 and the light-emitting layer forming step which forms the 3-color light-emitting layer 753.

The organic EL device 701 is manufactured by connecting wiring of the flexible substrate to the cathode 761 of the organic EL element 702 after manufacturing the organic EL element 702 and connecting the circuit element part 721 to the drive IC.

Next, a case of applying the liquid droplet ejection device of the embodiment of the invention to the manufacture of a liquid crystal display will be described.

Figure 12:
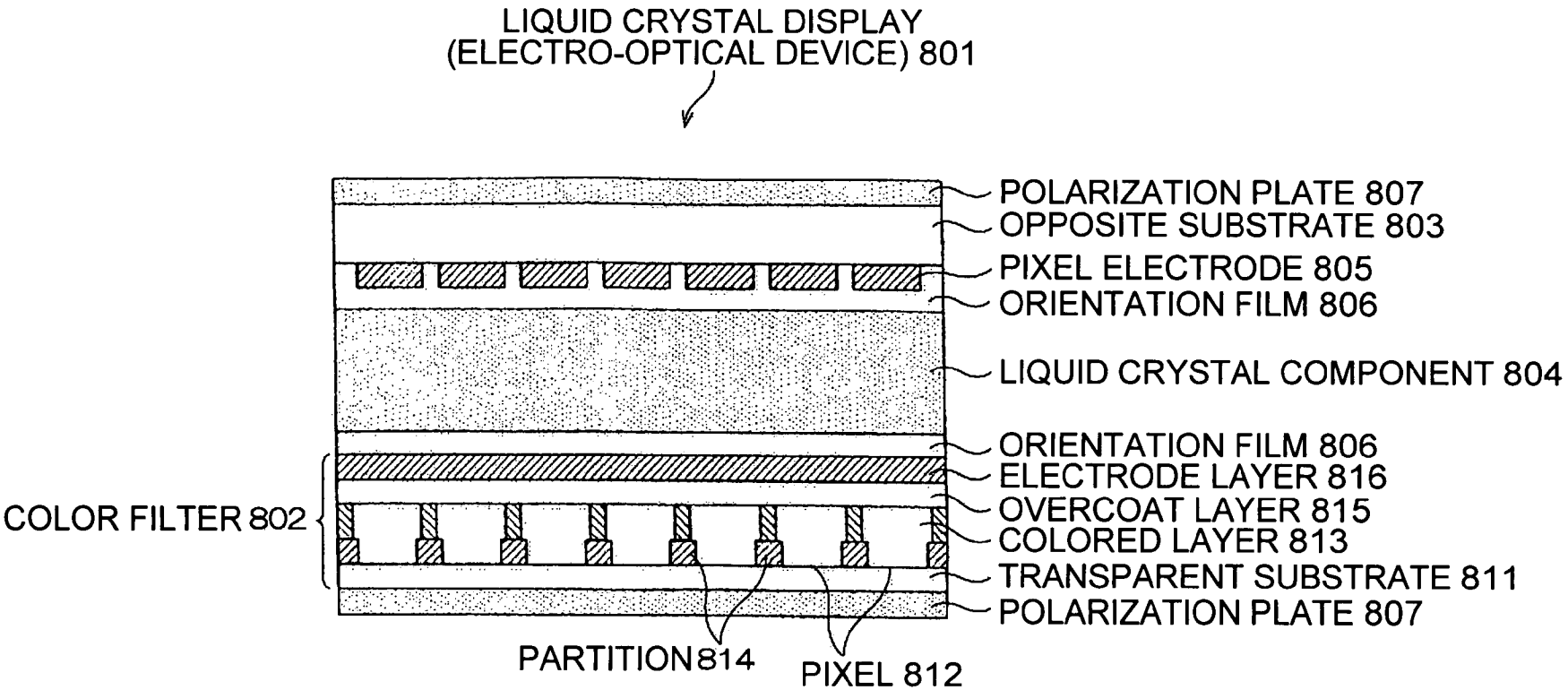
FIG. 12 is a sectional view showing a structural example of an organic EL device manufactured by the liquid droplet ejection device of the invention.

FIG. 12 shows a sectional structure of a liquid crystal display 801. The liquid crystal display 801 is made up of a color filter 802, an opposite substrate 803, a liquid crystal component material 804 sealed in between the color filter 802 and the opposite substrate 803, and a backlight (illustration omitted). On an inside surface of the opposite substrate 803 are formed a pixel electrode 805 and a TFT (Thin Film Transistor) element (illustration omitted) in a matrix pattern.

At a position opposite the pixel electrode 805, the colored layer 813 of red, green, and blue of the color filter 802 is arranged. On respective inside surfaces of the color filter 802 and the opposite substrate 803, there is formed an orientation film 806 which arranges liquid crystals in a fixed direction, and to respective outside surfaces of the color filter 802 and the opposite substrate 803, there is adhered a polarization plate 807.

The color filter 802 is provided with a translucent transparent substrate 811, a multiplicity of pixels (filter elements) 812 arranged in a matrix pattern on the transparent substrate 811, the colored layer 813 formed on the pixel 812, and a light shielding partition 814 dividing each pixel 812. On upper surfaces of the colored layer 813 and the partition 814, there are formed an overcoat layer 815 and an electrode layer 816.

A manufacturing process of a liquid crystal display 801 will be described. First, after the partition 814 is made and built on the transparent substrate 811, the colored layer 813 of R (red), G (green), and B (blue) is formed on the pixel 812 portion. Then, by spin coating a transparent acrylic resin paint, the overcoat layer 815 is formed. Further, the electrode layer 816 made up of ITO (Indium Tin Oxide) is formed and the color filter 802 is made.

The pixel electrode 805 and a TFT element are made and built on the opposite substrate 803. Next, after coating the orientation film 806 on the prepared color filter 802 and the opposite substrate 803 on which the pixel electrode has been formed, these are glued together. Then, after sealing the liquid crystal component material 804 in between the color filter 802 and the opposite substrate 803, the polarization plate 807 and the backlight are layered over.

The embodiment of the liquid droplet ejection device of the invention can be used for forming filter elements (colored layer 813 of R (red), G (green), and B (blue)) of the above-referenced color filter. Further, by using a liquid material corresponding to the pixel electrode 805, it is possible to use it for forming the pixel electrode 805.

Further, as other electro-optical devices, there may be considered a device including formation of a prepared specimen for microscope observation, in addition to metallic wiring formation, lens formation, photoresist formation, and photo-diffusion material formation. By using the above-referenced liquid droplet ejection device for manufacturing all sorts of electro-optical devices, it is possible to manufacture varieties of electro-optical devices efficiently.

Electronic equipment of the invention is mounted with the above-referenced electro-optical device. In this case, as electronic equipment, mobile phones, personal computers and all sorts of electrical products mounted with a flat-panel display correspond to this.

Figure 13:
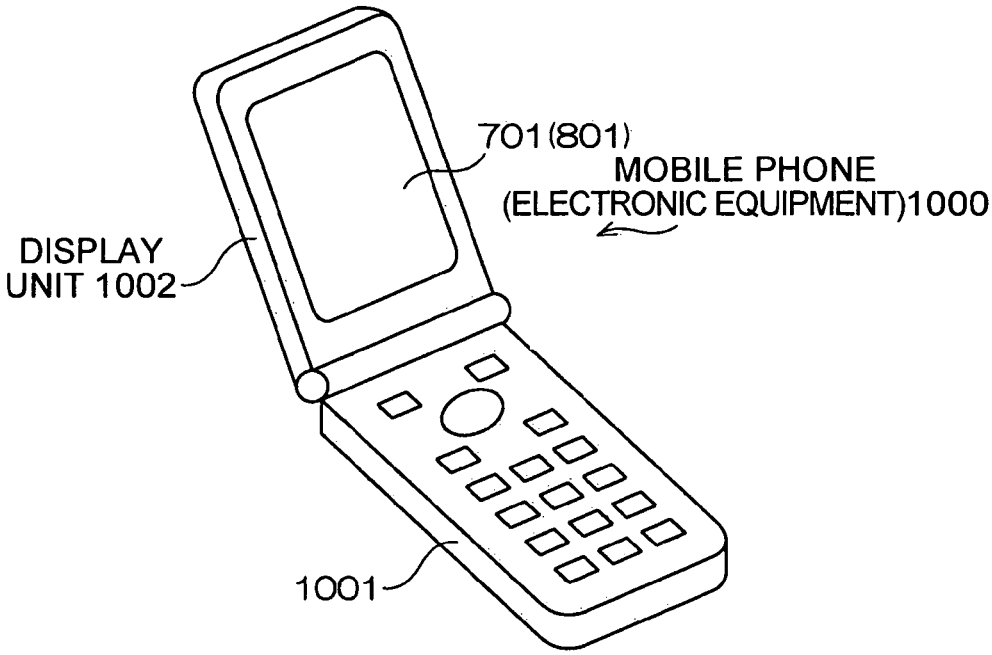
FIG. 13 is a perspective view of a mobile phone which is an example of electronic equipment having a display unit manufactured according to an embodiment of the invention.

FIG. 13 shows a shape example of a mobile phone 1000 which is an example of electronic equipment. A display unit 1002 uses the above-referenced electro-optical device such as an organic EL device 701 and a liquid crystal device 801.

Figure 14:
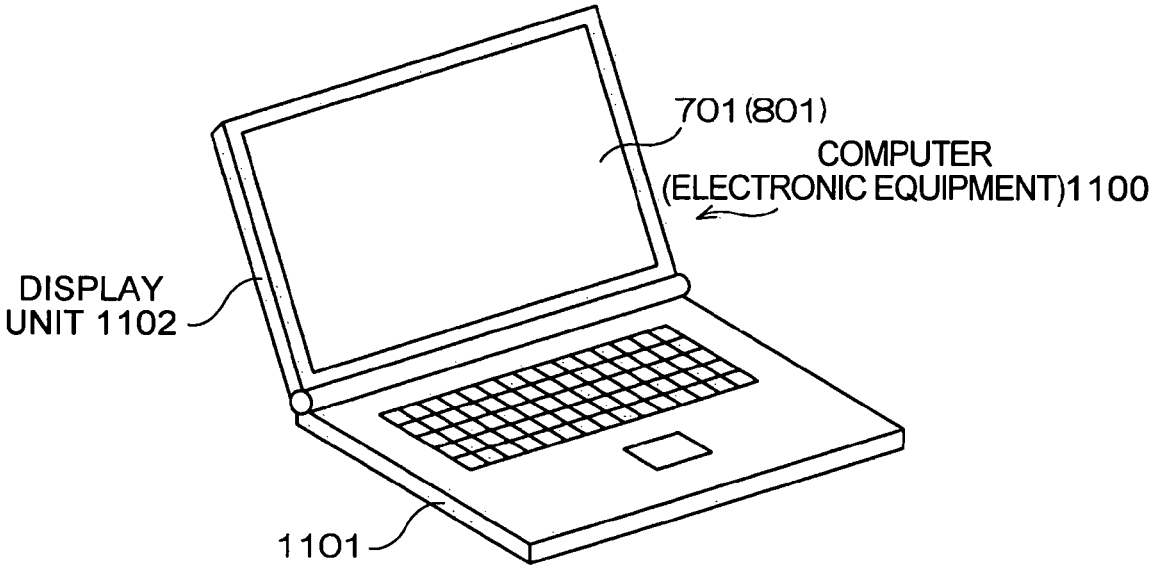
FIG. 14 is a perspective view of a computer which is another example of electronic equipment.

FIG. 14 shows a computer 1100 which is another example of electronic equipment. The computer 1100 has a main part 1101 and a display 1102. The display 1102 can use the organic EL device 701 or the liquid crystal device 801 which is an example of the above-referenced electro-optical device.

The embodiment of the liquid crystal ejection device of the invention can be used for rendering black and white or color printing (printed letters) with respect to a printing object which is an example of the workpiece. In this case, the liquid storage is an ink cartridge. This ink cartridge stores one kind or a plurality of kinds of ink (for example, black, yellow, magenta, cyan, light cyan, light magenta and the like) separately. Each ink is an example of the liquid.

The invention is not limited to the above-referenced embodiments and various modifications are possible within the scope of the spirit of the invention. Further, each of the above-referenced embodiments may be constructed through mutual combinations.

What is claimed is:

1. A liquid droplet ejection device for ejecting a liquid from a nozzle in a head to a workpiece, the liquid droplet ejection device comprising:

a table for loading the workpiece;

a first shifting section for shifting the table in a first direction and a second direction intersecting the first direction at approximately a right angle;

a plurality of carriages, each of the plurality of carriages having a head; and a second shifting section for positioning each of the plurality of carriages independently in the second direction and selecting at least one of the plurality of carriages so that the workpiece faces the at least one of the plurality of carriages and so that the workpiece does not face a remainder of the plurality of carriages.

2. The liquid droplet ejection device according to claim 1, comprising a maintenance section arranged at least at one position of the second direction for recovering an ejection capacity of the nozzle, the second shifting section positioning the remainder to face the maintenance section.

3. The liquid droplet ejection device according to claim 1, the second shifting section selecting the at least one of the plurality of carriages depending on a width of the workpiece.

4. The liquid droplet ejection device according to claim 1, the second shifting section controlling a total arrangement width of the heads of the plurality of carriages so as to correspond to a width of the workpiece by varying the number of carriages.

* * * * *

UNITED STATES PATENT AND TRADEMARK OFFICE

CERTIFICATE OF CORRECTION

PATENT NO. : 7,645,004 B2
APPLICATION NO. : 11/288456
DATED : January 12, 2010
INVENTOR(S) : An et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 418 days.

Signed and Sealed this

Sixteenth Day of November, 2010

David J. Kappos

David J. Kappos
*Director of the United States Patent and Trademark Office*